US007673810B2

(12) United States Patent
Young

(10) Patent No.: US 7,673,810 B2
(45) Date of Patent: Mar. 9, 2010

(54) RAIL CLIP

(75) Inventor: Hartley Frank Young, Melton (AU)

(73) Assignee: AirBoss Railway Products Inc., Kansas City, MO (US)

( * ) Notice: Subject to any disclaimer, the term of this patent is extended or adjusted under 35 U.S.C. 154(b) by 591 days.

(21) Appl. No.: 11/532,133

(22) Filed: Sep. 15, 2006

(65) Prior Publication Data

US 2007/0063064 A1 Mar. 22, 2007

(30) Foreign Application Priority Data

Sep. 20, 2005 (AU) ..... 2005905171

(51) Int. Cl.
*E01B 9/00* (2006.01)

(52) U.S. Cl. ..... 238/351; 238/349

(58) Field of Classification Search ..... 238/349, 238/351, 338, 343, 352
See application file for complete search history.

(56) References Cited

U.S. PATENT DOCUMENTS 4,313,563 A 2/1982 Young et al.
5,605,284 A * 2/1997 Young ..... 238/351
6,367,704 B1 * 4/2002 Mediavilla ..... 238/310

FOREIGN PATENT DOCUMENTS

GB 781406 8/1957

* cited by examiner

*Primary Examiner*—Mark T Le
(74) *Attorney, Agent, or Firm*—Connolly Bove Lodge & Hutz LLP

(57) ABSTRACT

A rail fastening clip is used with a rail clip support having a rail clip slot of the kind used in K plates. The rail clip is formed from a U shaped member made of metal plate having a base and two arms tapered from the base to their tips, with the arms being bent inwardly beyond the base in a large arc and the tips are bent back toward the base and oriented for contact with the foot of the rail. The base is adapted to fit in the K plate slot of the rail clip support. The base of the clip has a leading edge remote from the arms that contacts the upper interior surface of the support slot to form at least a line of contact with the upper interior surface of the slot. The line of contact is about 6 mm. The design overcomes the problem of rotation of the clip within the support slot and is a more cost effective clip than that currently used with K plates.

6 Claims, 7 Drawing Sheets

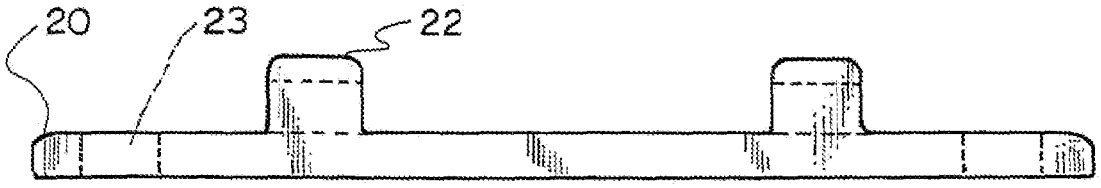
(PRIOR ART) Fig. 1
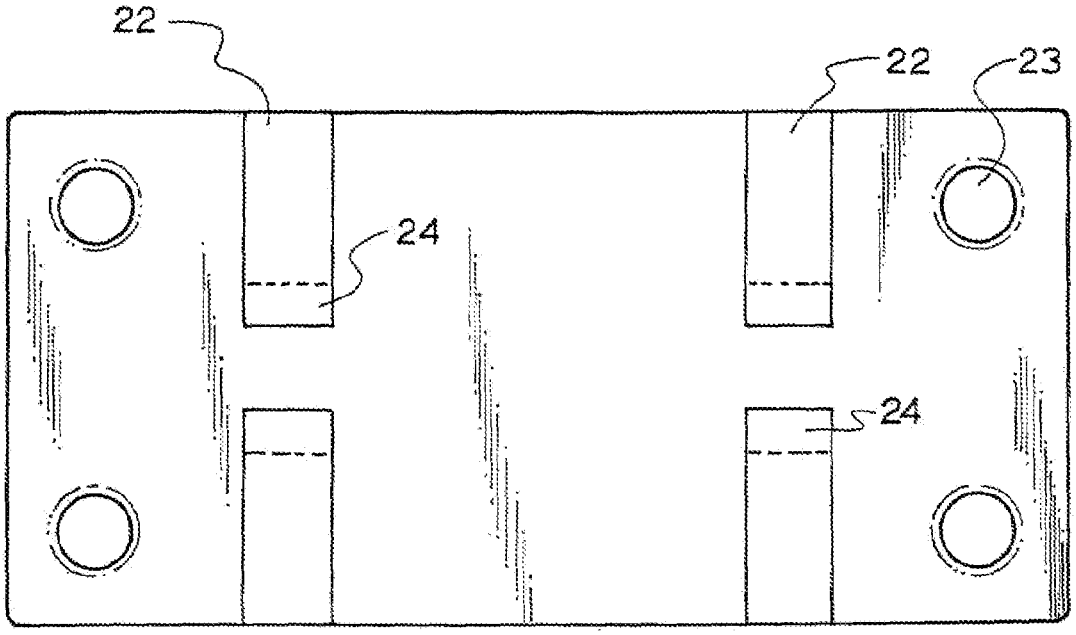
(PRIOR ART) Fig. 2
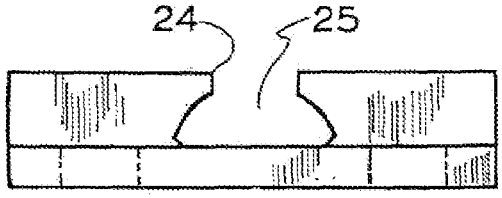
(PRIOR ART) Fig. 3

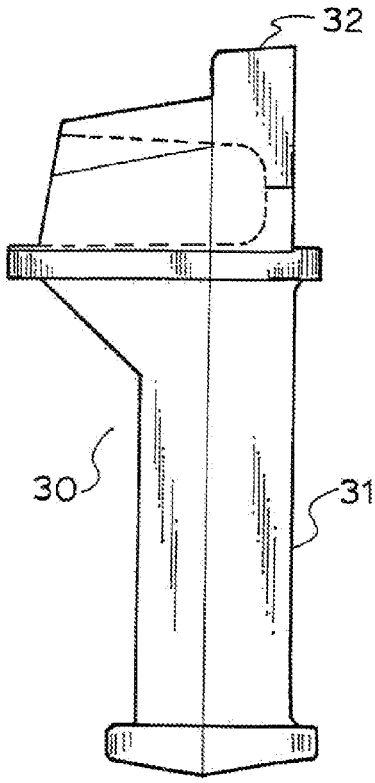
(PRIOR ART) Fig. 4
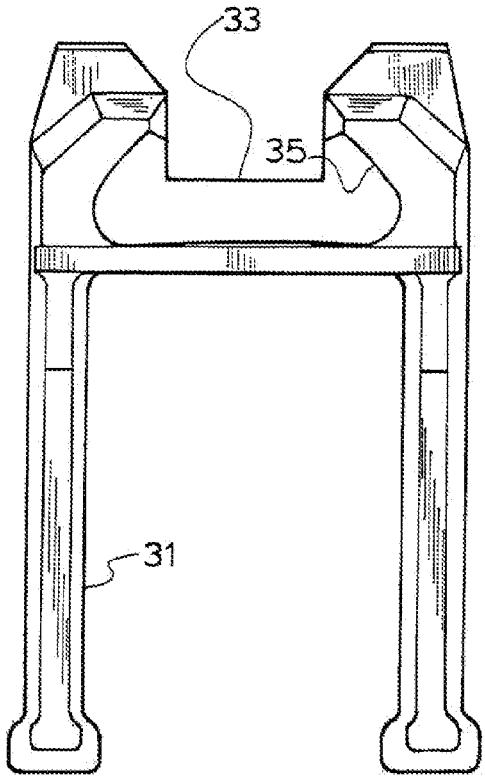
(PRIOR ART) Fig. 5
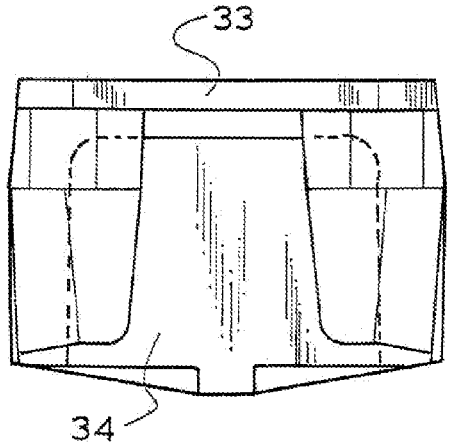
(PRIOR ART) Fig. 6

SECTION A-A

SECTION A-A

SECTION B-B

SECTION C-C

SECTION D-D

Fig. 17D
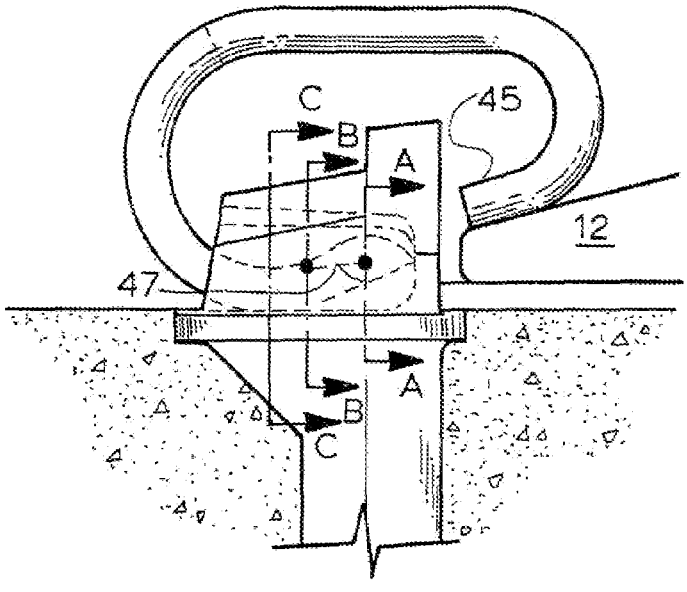
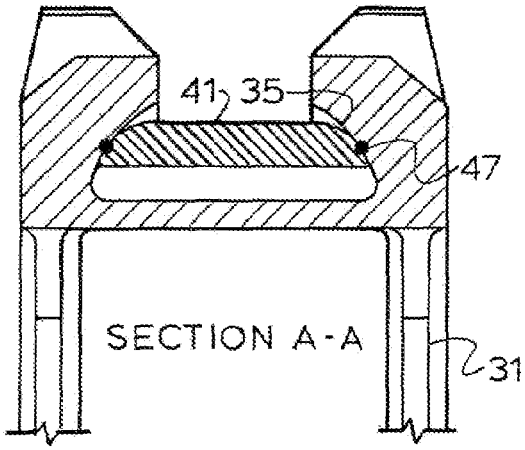
Fig. 17A
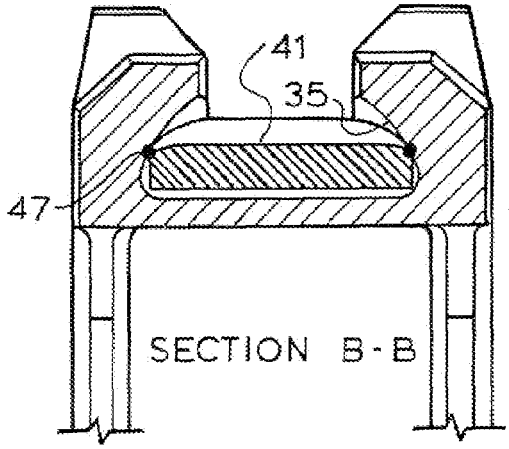
Fig. 17B
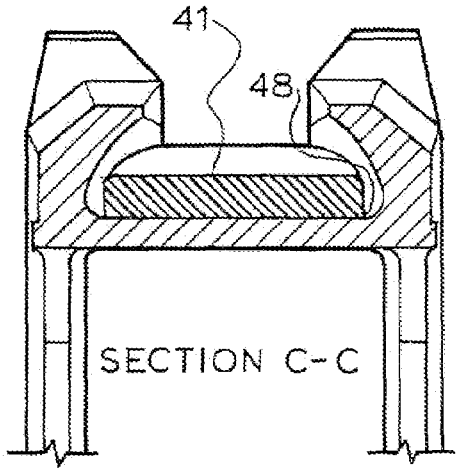
Fig. 17C

RAIL CLIP

This invention relates to an improved rail fastener adapted to be used with existing rail plates on wooden rail ties or equivalent support shoulders in concrete ties.

BACKGROUND TO THE INVENTION

Dog spikes have been used to hold rails down to wooden railway sleepers for a very long time and in some places they are still used. While they are cheap and simple they do not provide longitudinal restraint to the rail and additional rail anchors must be used for this.

In Europe an upgraded method of clamping the rail to the tie came into use which was made up of a steel plate (commonly called a K plate) under each rail and the plate was attached to the tie by the means of screw spikes. The rail in turn was clamped to the K. plate by means of two tee bolts in each plate which acted upon 2 clamps holding the rail down when the nuts on the captive tee bolts were tightened. However in spite of large spring washers underneath the nuts on the tee bolts they tended to work loose due to vibration in service. Men were employed to walk along the track and keep these bolts tight.

British patent 781406 discloses an elastic clip which was driven into the slot originally intended to hold the head of the tee bolts on the K plate and the toe of this clip acted on the top of the rail base and held it down thus eliminating the tee bolts and nuts. Patent 781406 was filed in October 1955 and in some parts of the world the clip is still being manufactured. It is known as the DE clip and although the patent shows it being made from round bar most of the clips are in fact made from 12 mm square bar with a 3 mm radius on each corner. The slot in the K. plate has a flat bottom with an upper surface comprising two sides each forming an arc and a slot between them to accommodate the tee bolt.

In some locations cast metal shoulders have been used in concrete ties which have a similar slot to the K. plate and were originally designed to accept the DE clip.

The K plate slot does not match the square bar used in the D E clip very well and the bar is not as high as the slot so the base of the clip takes up an angle as it is restrained in the slot. The forward part of the base bears on the top of the slot and the back of the base sits on the bottom of the slot. The front top part of the D E clip base is shaped to match the circular arcs on the top of the slot.

However this arrangement does not provide very good rotational location for the clip and in track when the clips are viewed from the top it is common to see the D E clip central axis out of alignment with the tie centre. This is often caused by track working machines such as ballast plows which apply indirect forces through the ballast to the sides of the clips. The misalignment tends to cause damage to the clips particularly when they are removed and a general loss of efficiency of the system which is eliminated by this new improved fastener which also has other important advantages.

U.S. Pat. No. 4,313,563 discloses an improved rail clip formed from metal plate with tapered legs. However because of the superior performance of the flat plate & tapered leg configuration the thickness of the material is much less than for the DE clip but since the height of the slot in the K plate is fixed this plate form of rail clip is not suitable for the K plate slot.

It is an object of this invention to provide a modification to the clip described in U.S. Pat. No. 4,313,563 so that it can perform effectively in slots of the K plate type. It is a further object of this invention to provide a rail clip that has a reduced tendency to rotate within the slot.

BRIEF DESCRIPTION OF THE INVENTION

To this end the present invention provides a rail clip to be used with a rail clip support having a rail clip slot of the kind used in K plates the rail clip being formed from a u shaped member made of metal plate having a base, a curved back and two tapered arms, said arms being bent inwardly beyond the base in a large arc and the tips are bent back toward the base and oriented for contact with the foot of said rail and the base being adapted to fit in the slot of the rail clip support, the base of said clip being characterised as having a leading edge remote from the arms that contacts the upper interior surface of said slot to form at least a line of contact with the surface of said slot.

This invention eliminates the problem of rotation by shaping the top of the clip base so that the front contacts the top arcs of the K slot towards the outer sides which have an inclination of approximately 45° and line contact backwards toward the slot opening is achieved. As the front of the base is forced upwards it wedges itself into the top surface of the K slot & because of the line contact at the sides it resists rotational movement in a similar manner to a spanner on a nut.

Since there are still large numbers of K plates remaining in service this new invention provides a way to reduce track maintenance costs while they are still used. This invention can also be used for support shoulders in concrete ties that have a similar slot to the K plate.

Because the clip disclosed in U.S. Pat. No. 4,313,563 is not shaped to fit the K plate slot the clip of this invention is shaped so that the base of the clip can assume an angle of from 10° to 40° to the base of the slot. The thickness of the clip base is usually between 7 and 10 mm thick. Unlike the clip disclosed in U.S. Pat. No. 4,313,563, in the rail clip of this invention the arms commence from the curved back of the clip and not the base. This provides a better surface to apply the application force to when installing the clip. During installation of DE clips the application force may only be applied to one leg of the clip resulting in damage to the clip.

One of the disadvantages of the DE clip is that when it is applied to the K plate and equivalent shoulders for concrete ties the clip must be first started in the shoulder by using a special tool which squeezes the toes sidewards so that they can be entered into the vertical slot. Then a second action by another tool or machine is required to drive it onto the rail. The clip of this invention can be driven onto the rail without using a side squeeze tool first which saves time and labour.

In this invention the rail clip support includes a slot for the rail clip base and a channel ending in a gate for the toes of the clip to travel through as the clip is driven onto the base of the rail. The channel narrows toward the gate to squeeze the toes of the clip together as they pass through the gate. By making the front of the clip narrower than the vertical slot in the shoulder it can be started in the slot. The toes of the clip then extend outwards as they project backwards so that the act of driving the clip on automatically deflects the toes inwards until they pass completely through the gate & they then spring outwards to prevent the clip from coming off the rail foot.

DETAILED DESCRIPTION OF THE INVENTION

A preferred embodiment of the invention will be described with reference to the drawings in which:

FIG. 1 is a side elevation of a typical K plate;

FIG. 2 is a plan view of a K plate;

FIG. 3 is an end view of a K plate showing the slot with curved upper surfaces which retain the tee bolt;

FIG. 4 is a side elevation of a cast metal shoulder with a clip slot similar to the one in a K plate;

FIG. 5 is an end elevation of a cast metal shoulder with a clip slot similar to the one in a K plate;

FIG. 6 is a plan view of a cast metal shoulder with a clip slot similar to the one in a K plate;

FIG. 17A-17D show the contact line at the side of the clip base in cross section and in sections AA, BB and CC.

Figure 7:
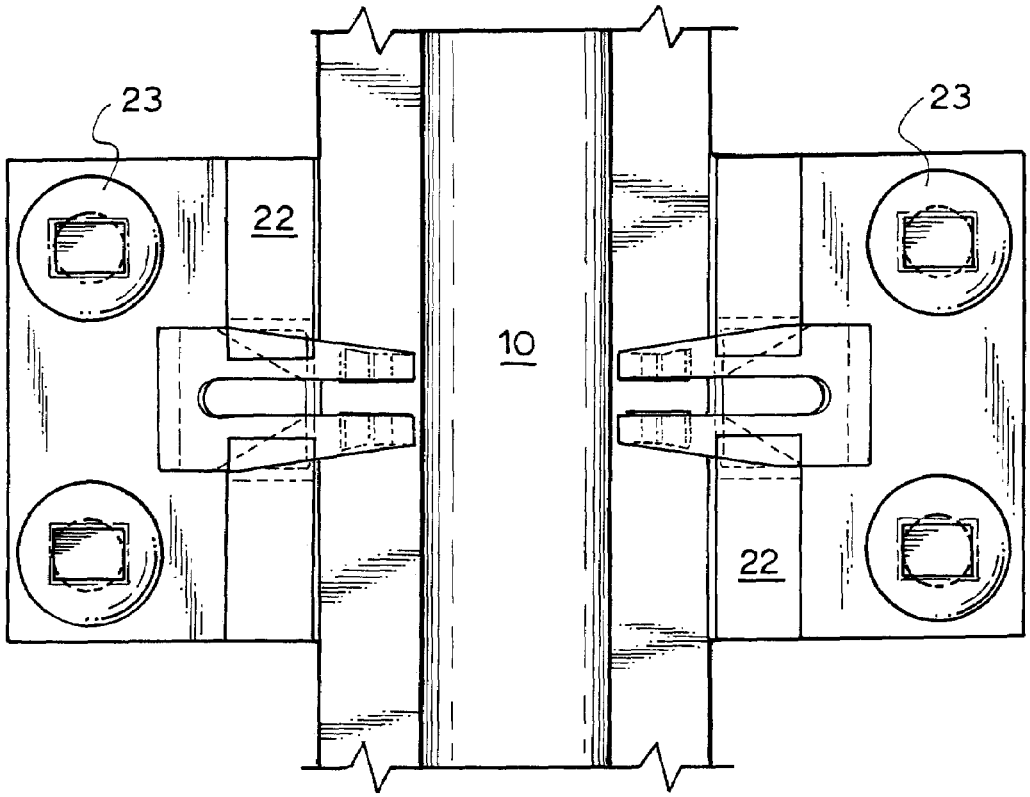
FIG. 7 is plan view of the fastener of this invention in a K plate.
Figure 8:
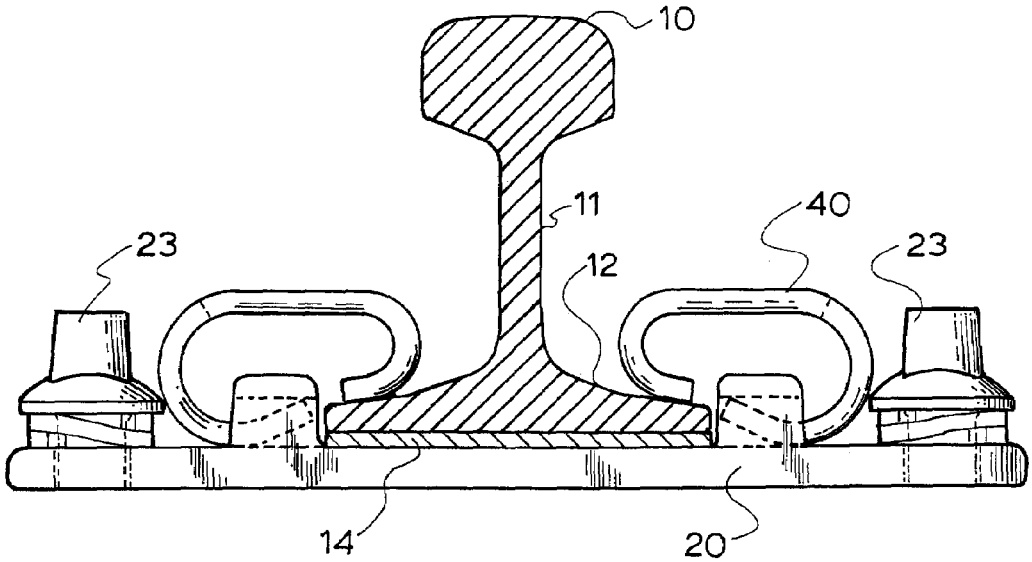
FIG. 8 is a side elevation of the fastener of this invention in a K plate.

The prior art K plate 20 is shown in FIGS. 1 to 3 and consists of four shoulders 22 defining two slots 25 on either side of where the rail 10 is held. The holes 23 allow the plate 20 to be fastened to a rail tie as shown in FIGS. 7 and 8. The rail consists of the flange 11 and the foot 12 on which the toes of the rail clip seat.

Figure 9:
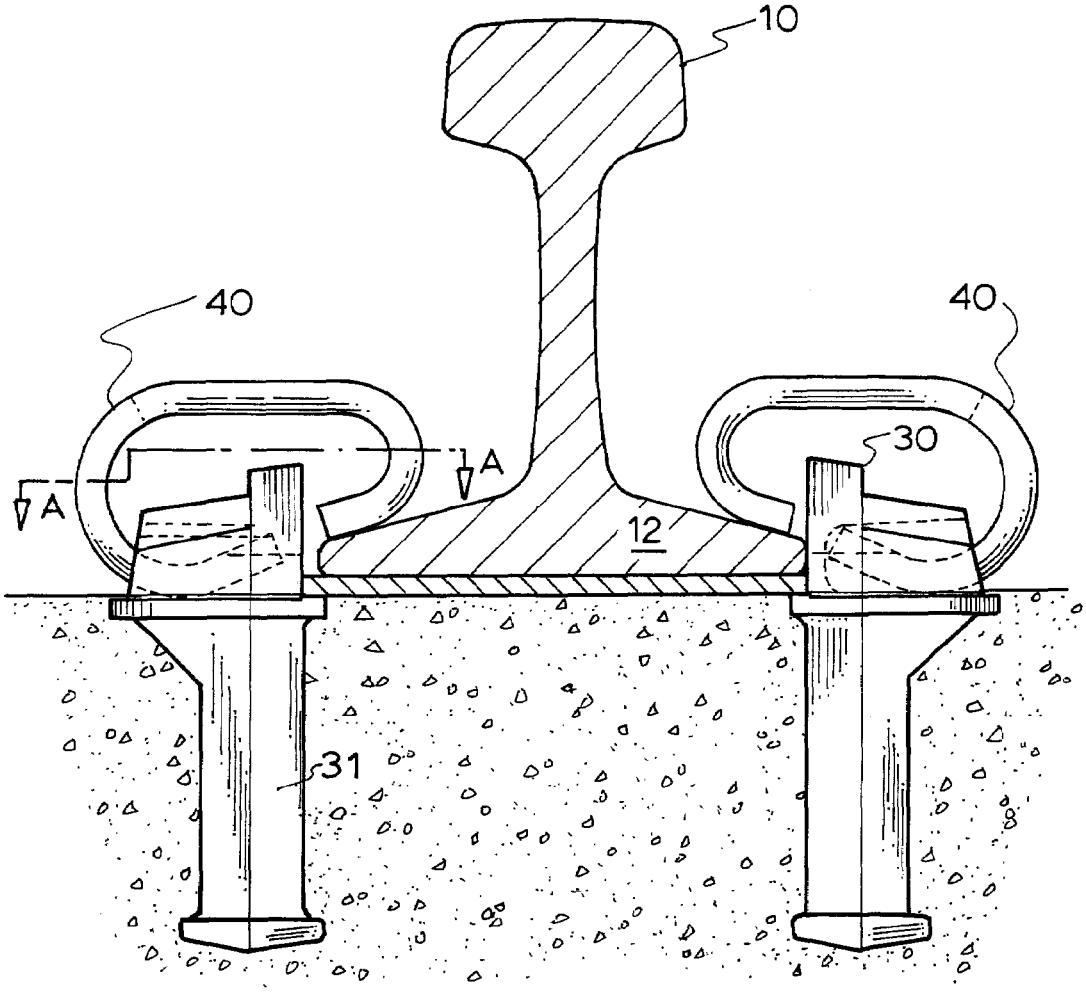
FIG. 9 is a side elevation of the fastener of this invention on a concrete tie having cast metal shoulders with slots similar to those in a K plate.
Figure 10:
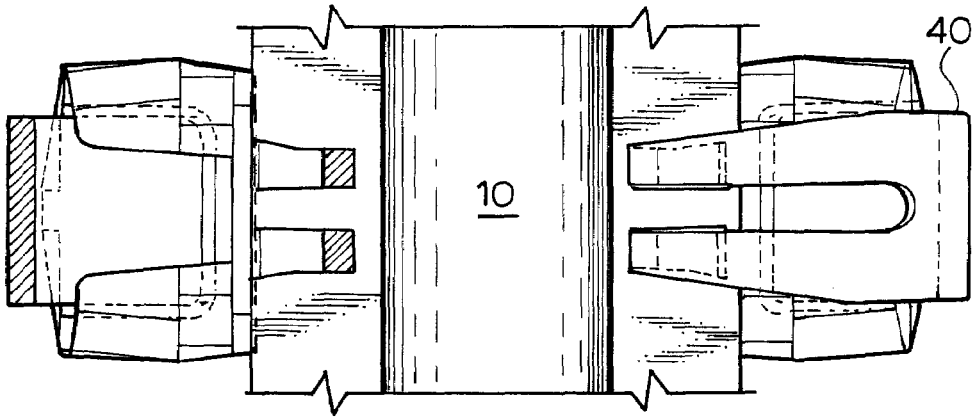
FIG. 10 is a plan view of the fastener of this invention on a concrete tie having cast metal shoulders with slots similar to those in a K plate.
Figure 11:
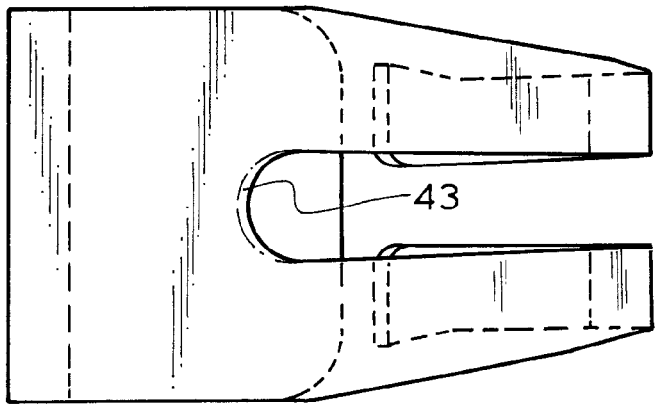
FIG. 11 is a plan view of the fastener of this invention.
Figure 12:
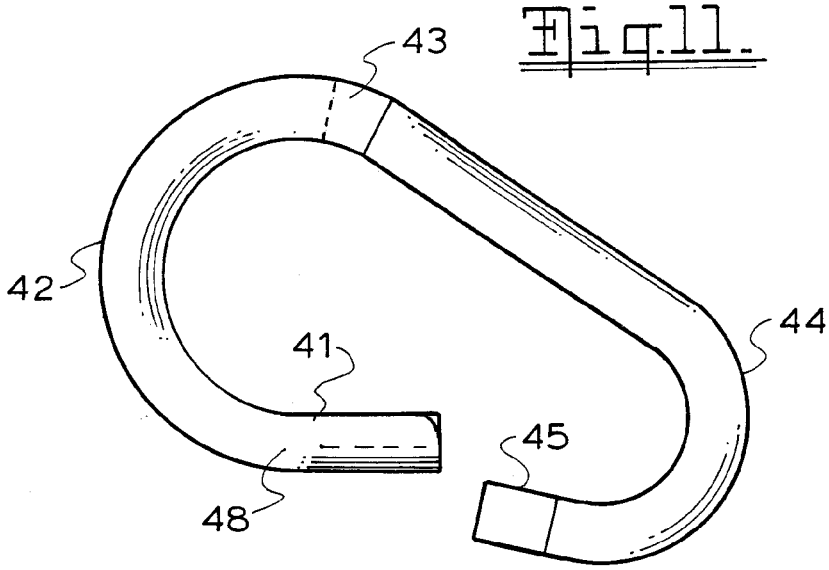
FIG. 12 is a side elevation of the fastener of this invention.

For concrete ties a support shoulder embedded in the tie is used and the prior art shoulder 30 is shown FIGS. 4 to 6. It consists of the legs 31 and the shoulder 32 which on the rail side has a gate 33 for the toes 45 of the rail clip 40 to pass through. The base 41 of the rail clip 40 is held in the slot 34 which is of the same general shape as the slot 25 of the K plate. The surface 35 at the upper internal end of slot 34 is curved and is abutted by the shaped corners 46 of the base 41 of the rail clip. The rail seat of a concrete tie is shown in FIGS. 9 and 10.

The rail clip 40 of this invention is shown in FIGS. 11 to 16. It consists of a base 41 with its free end having the shaped corners 46 seen in detail in FIGS. 14 to 16. The base 41 is between 7 mm and 10 mm thick. The lower edge 48 adjacent the rear of base 41 where it merges into the curved body section 42 is a sharp edge. The curved section 42 provides a solid back surface to which the installation force is applied to drive the clip onto the rail. The tapered arms of the clip 40 commence at the top 43 of the clip and extend forward to the smaller curved portion 44 and then to the tips or toes 45.

Since the base 41 of the clip is tilted upwards, usually from 10° to 40° the points of contact along the contact line 47 must move outwards as the line moves backwards to compensate for the increasing chordal width between the two opposing sides of the K slot arcs corresponding with the descending angle of the base as best seen in section AA and BB of FIGS. 17A-17B.

A convenient way to achieve this is to provide spherical radii arcs on the front top corners 46 of the clip base 41 and then transitioning them to cylindrical radii moving backwards and outwards. The sides of the clip then truncate the cylindrical shapes as shown progressively in sections AA, BB, CC & DD of FIGS. 16A-16D.

As the clip 40 is driven into the plate 20 or shoulder 30 very high forces are generated on the front upper contact region 46 of the base 41 and it is common for metal pickup to occur and for the slot 25 or 34 to be gouged so while line contact at the sides is desired there is preferably no sharp edges and the contacting surfaces need to be of similar shape so that the line contact is preferably a narrow band to distribute the load. The incline angle of the base changes as the clip is driven on so the leading edge of base is preferably well rounded to avoid damage to the sliding surfaces 46 and 35 before it takes up the final position. In FIGS. 17A, 17B and 17D the band of contact 47 is shown and generally is about 6 mm in length. Section AA of FIG. 17A shows the side contact points at that position. Section BB shows the side contact points at that position. Section CC shows the sharp corners on the bottom of the clip base.

The rotational resistance of the base 41 is further enhanced by providing sharp corners 48 on the bottom of the clip base 41 where it sits on the floor of the K slot 25 or 34 so that sidewards movement is resisted by the corners 48 biting into the floor and bottom radii as the base tends to slide sideways during rotation. This contrasts with the rounded corners of the square bar used on the DE clip which will not bite into the slot. See section CC FIG. 17C One of the disadvantages of the prior art DE clip is that, when it is applied to the K plate and equivalent shoulders for concrete ties, the clip must be first started in the shoulder by using a special tool which squeezes the toes sidewards so that they can be entered into the vertical slot. Then a second action by another tool or machine is required to drive it onto the rail.

Figure 13:
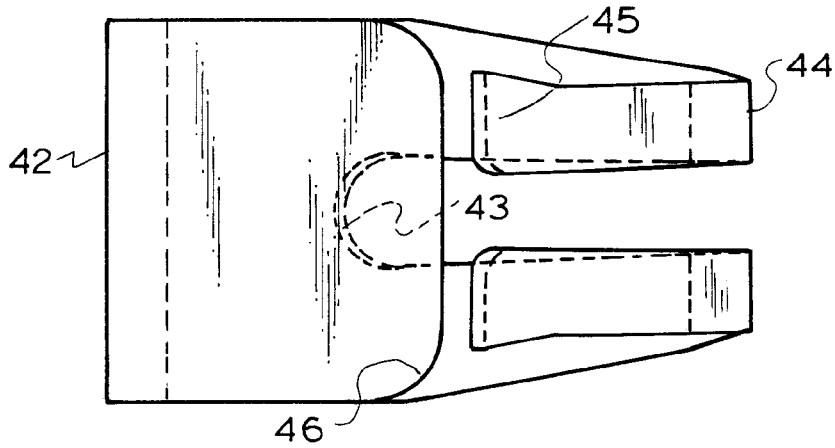
FIG. 13 is a bottom view of the fastener of this invention.
Figure 14:
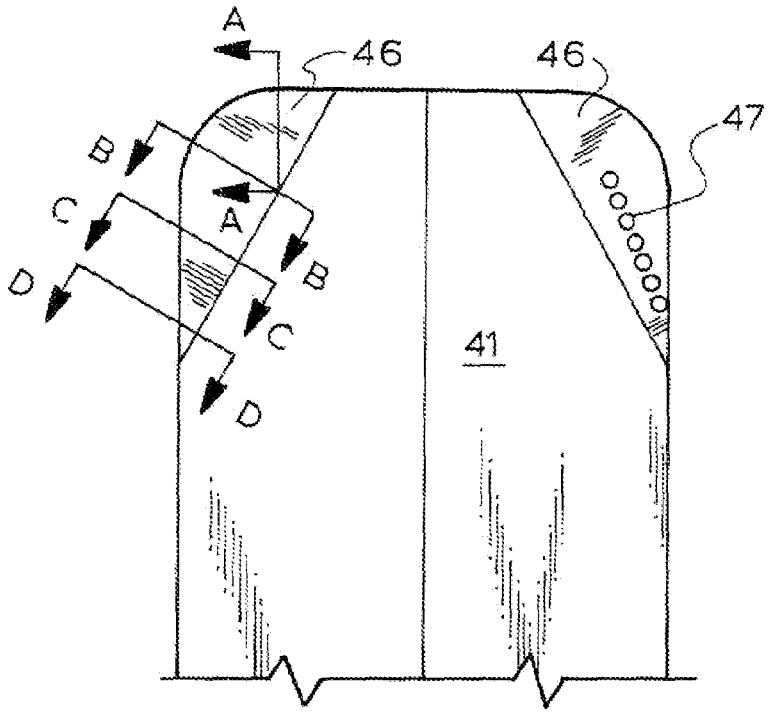
FIG. 14 is plan view of the base of the fastener of this invention having spherical radii on the corners which transition to cylindrical radii projecting backwards and outwards.
Figure 15:
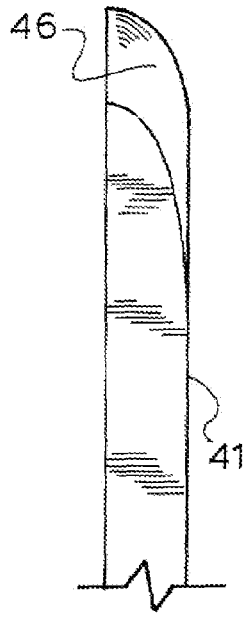
FIG. 15 is a side elevation of the base of the fastener of this invention.
Figure 16A:
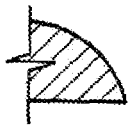
FIG. 16A-16D show sections AA, BB, CC and DD of FIG. 14.
Figure 16B:
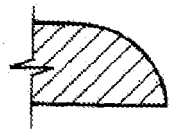
Figure 16C:
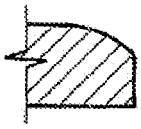
Figure 16D:
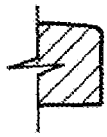

The clip 40 of this invention can be driven onto the rail foot 12 without using a side squeeze tool first which saves time and labour. This is achieved by making the front of the clip 44 as shown in FIG. 13, narrower than the vertical slot in the shoulder leading to the gate 33, so that it can be started in the slot. The toes 45 of the clip then extend outwards as they project backwards so that the act of driving the clip on automatically deflects the toes 45 inwards until they pass completely through the gate 33 and they then spring outwards to prevent the clip from coming off. FIGS. 7 and 10 show the channel slot leading to gate 33. From the above description it will be realised that this invention provides a more cost effective and better performing clip for use with the K plate or the support shoulder having a K plate slot.

Those skilled in the art will realise that this invention can be implemented in embodiments other than those illustrated without departing from the core teachings of this invention.

The invention claimed is:

1. A rail clip to be used with a rail clip support having a rail clip slot in a K plate, the rail clip being formed from a U shaped member made of metal plate having a base, a curved back and two tapered arms, said arms being bent inwardly beyond the base in a large arc and having tips that are bent back toward the base and oriented for contact with a foot of a rail and the base being adapted to fit in the slot of the rail clip support in the K plate, the base of said clip having a leading edge remote from said arms that contacts an upper interior surface of said slot to form a line of contact with a surface of said slot, which contact is achieved by spherical radii at front top corners of the clip base and these radii then converge to cylindrical radii and extend backwards towards a rear of the base and also outwards laterally and finally being truncated by vertical sides of the clip base.

2. A rail clip as in claim 1 wherein the length of the line of contact is at least 6 mm.

3. A rail clip as claimed in claim 1 wherein the base of the clip has a sharp corner junction between a bottom surface of the clip base and sides of the clip base in the region where the base contacts a bottom floor of the clip slot in a shoulder or tie plate.

4. A rail clip as claimed in claim 1 where the thickness of the base is between 7 and 10 mm thick.

5. A rail clip as claimed in claim 1 wherein front top sides of the clip base form a wedge fit in a shoulder slot when an upward force is applied to a front of the base.

6. A rail clip as claimed in claim 1 where the clip base seats in a shoulder slot with a front tilted upwards at an angle of 10° to 40° relative to a base of the rail.

* * * * *